United States Patent [19]

Robertson et al.

[11] Patent Number: 5,016,545

[45] Date of Patent: May 21, 1991

[54] ADJUSTABLE DISPLAY STAND

[75] Inventors: J. D. Robertson, Atlanta; Ladd M. Orr, Clarkston, both of Ga.

[73] Assignee: The Mead Corporation, Dayton, Ohio

[21] Appl. No.: 527,540

[22] Filed: May 22, 1990

[51] Int. Cl.[5] ..... A47B 3/00

[52] U.S. Cl. ..... 108/111; 108/102; 211/135

[58] Field of Search ..... 108/111, 106, 153, 102, 108/137; 211/135, 195, 149, 150; 206/44 R, 45.29, 45.15

[56] References Cited

U.S. PATENT DOCUMENTS

| | | | |
|---|---|---|---|
| 722,760 | 3/1903 | Scarborough | 211/149 X |
| 2,724,509 | 11/1955 | Youngberg | 108/102 X |
| 3,010,585 | 11/1961 | Slikkers | 108/1 |
| 3,570,679 | 3/1971 | Edson | 108/1 X |
| 3,648,626 | 3/1972 | Schuster | 211/135 X |
| 4,151,803 | 5/1979 | Ferrera et al. | 108/111 X |
| 4,155,312 | 5/1979 | Thorkildson | 108/102 X |
| 4,500,146 | 2/1985 | Peterson | 108/102 X |
| 4,506,790 | 3/1985 | Muscari | 211/135 X |
| 4,523,722 | 6/1985 | Cohen et al. | 108/102 X |

*Primary Examiner*—José V. Chen

*Attorney, Agent, or Firm*—Rodgers & Rodgers

[57] ABSTRACT

For displaying items at a point of purchase, a pair of separate upright supports are arranged disjointably to engage shelf ends secured to the ends of shelves which themselves constitute a plurality of transversely severable components whereby shelf length may be reduced together with pivots for disjointably securing each shelf end to one of the upright supports so that the effective length and capacity of the shelves are rendered adaptable for particular applications.

14 Claims, 4 Drawing Sheets

ADJUSTABLE DISPLAY STAND

TECHNICAL FIELD

This invention relates to display stands for use in retail outlets and the like.

BACKGROUND ART

Canadian patent 1,206,445 issued June 24, 1986 and owned by the assignee of this invention discloses a multi shelf display stand for use in retail outlets and the like for displaying a variety of items such as soft drinks and the like.

The stand formed according to Canadian patent 1,206,445 utilizes components which are of fixed dimensions so that this device is of predetermined dimensional characteristics and capacity.

SUMMARY OF THE INVENTION

According to this invention in one form an adjustable display stand is provided which includes a pair of spaced apart separate upright supports, a plurality of shelves supported at their ends by said upright supports, each of said shelves being formed of a plurality of transversely severable components whereby the shelf length may be reduced, a pair of shelf ends respectively secured to opposite ends of each of said shelves, at least one shelf end being disjointable from its associated shelf, together with mounting means for securing each of said shelf ends to an associated one of said upright supports. While the invention is not limited to any particular material, corrugated paperboard or plastic material may be used.

BEST MODE OF CARRYING OUT THE INVENTION

Figure 1:
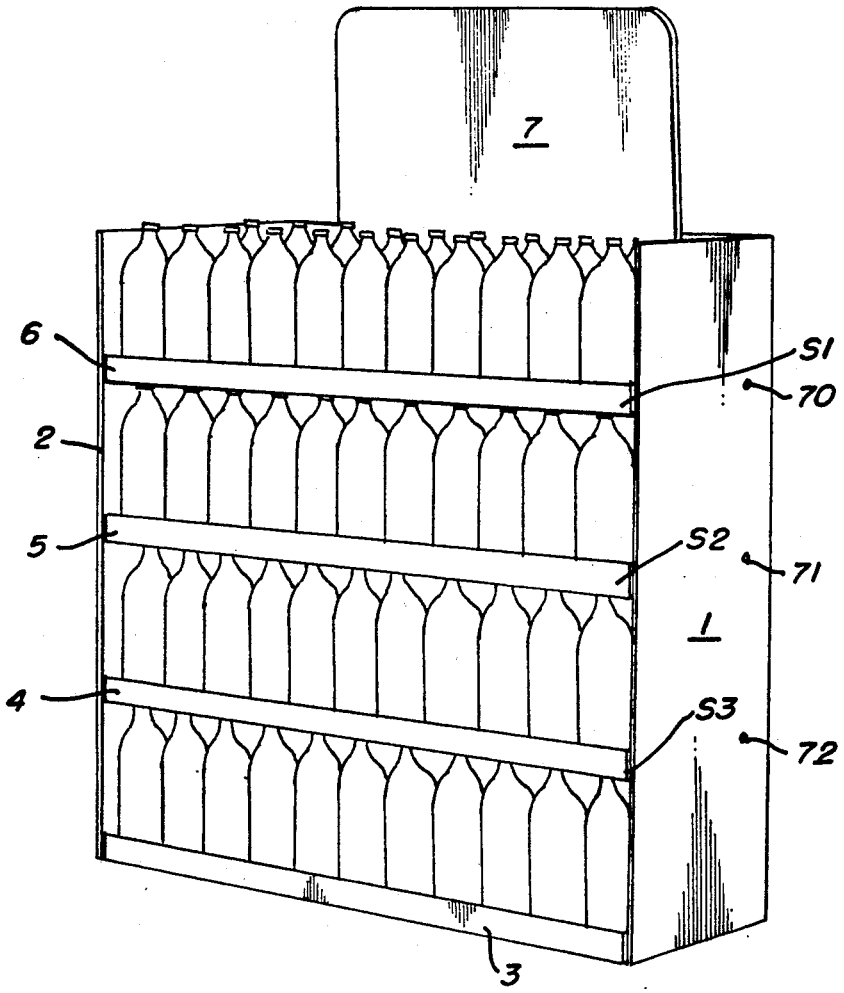
FIG. 1 is a perspective view of an assembled and fully loaded display stand formed according to this invention.

With reference to FIG. 1, the numerals 1 and 2 designate upright supports formed according to this invention. The numeral 3 designates a base panel which rests on a floor or other support and whose length is adjustable according to a feature of this invention. Disposed above the base panel 3 are spaced shelves 4, 5 and 6. A header panel 7 is removably mounted on the stand such as by vertical spaced apart slits (not shown) but which may be formed along the bottom edge thereof for receiving parts of the upright supports 1 and 2, and like the exposed surfaces of the vertical portions of upright supports 1 and 2 may afford space for displaying attractive graphics, trademark designations and the like.

Figure 7:
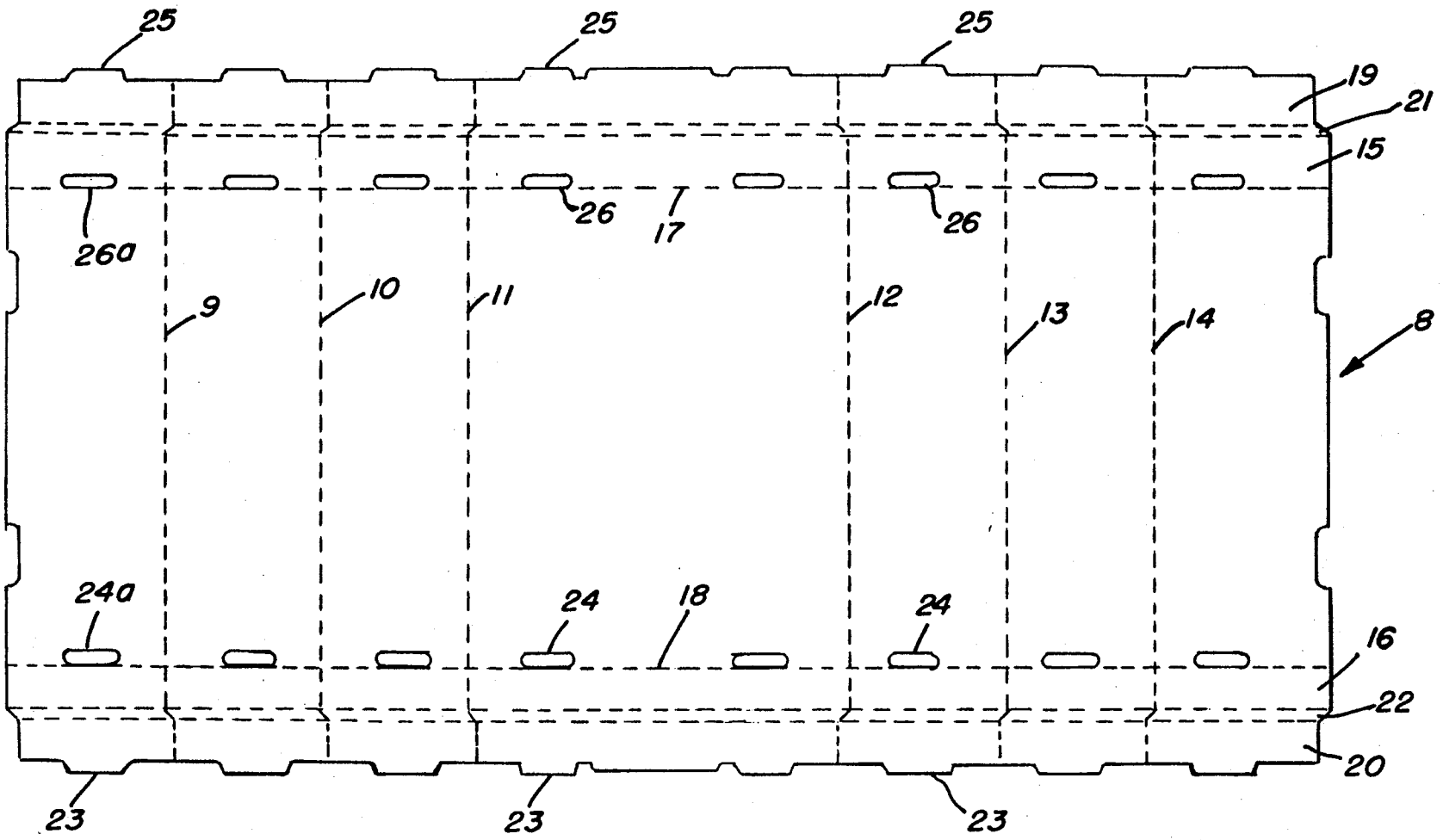
FIG. 7 is a plan view of base panel and of outer and inner front and back wall panels of a shelf formed according to this invention.

An adjustable shelf formed according to this invention is shown in FIGS. 2, 3, 4 and 7. The basic shelf unit as shown in FIG. 7 includes a base panel 8 in which a plurality of weakened transverse severance lines 9, 10, 11, 12, 13 and 14 are formed. The blank of FIG. 7 may be shortened by severing the blank along an of the severance lines 9–14. Outer wall panels 15 and 16 are foldably joined to the base panel 8 along fold lines 17 and 18 respectively. Inner side wall panels 19 and 20 are foldably joined respectively to outer side wall panels 15 and 16 along double score lines 21 and 22. A plurality of holding tabs 23 project from inner side wall panel 20 and are arranged to be received within a plurality of holding apertures 24 formed in base panel 8 along the fold line 18.

At the other side of the blank shown in FIG. 7, a plurality of holding tabs 25 are formed along the edge of inner side wall panel 19 and are arranged to be inserted into holding apertures such as 26 which are formed in base panel 8 along the fold line 17.

Figure 4:
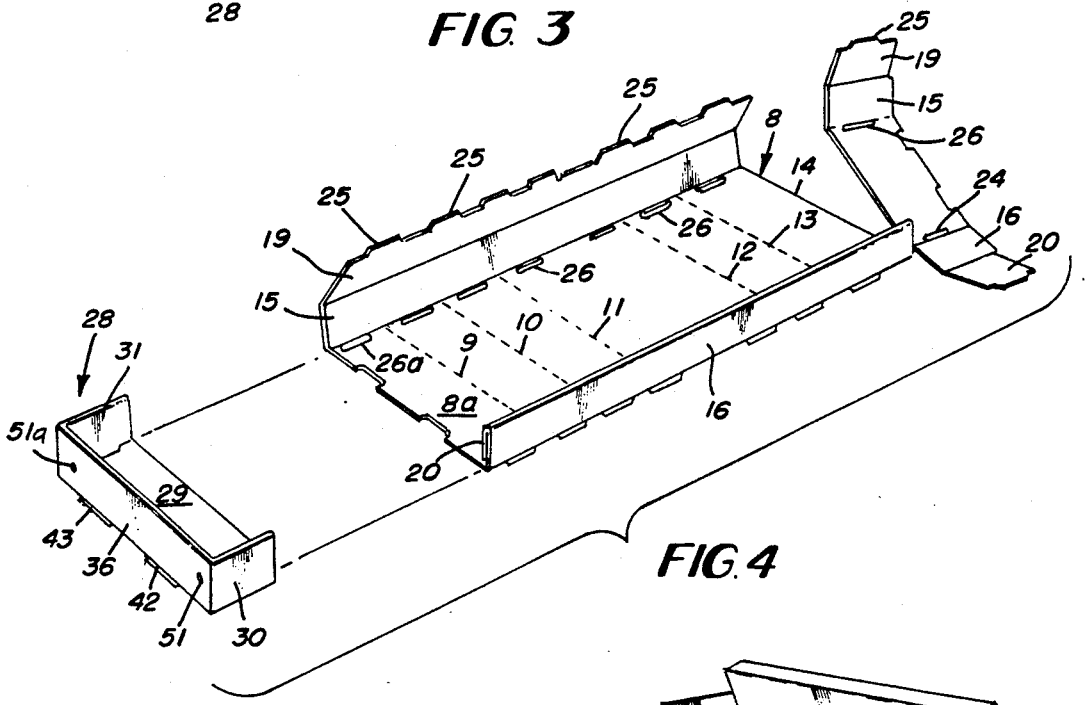
FIG. 4 is an exploded view of the central base panel of a shelf together with outer and inner side wall panels and of one shelf end formed from the blank shown in FIG. 3.

As is apparent in FIG. 4, outer side wall panel 15 and inner side wall panel 19 are in the process of being manipulated into set up condition in which holding tabs 25 are inserted into holding apertures 26 and the side wall thus formed is disposed in normal perpendicular relationship with respect to the base panel 8. The opposite side wall is shown in fully set up condition.

As is apparent in FIG. 4, the overall length from one side to the other of the base panel 8 may be shortened by severing the blank along any one of the weakened severance lines 9–14. FIG. 4 shows severance having been effected along the severance line 14.

As is apparent in FIG. 7, the severance lines 9–14 extend clear across the blank through the side wall panels 15, 16, 19 and 20. In FIG. 4 the weakened severance lines are not shown as extending through the side wall panels 15, 16, 19 and 20 for the sake of simplicity and in order to avoid undue crowding of structure and a clutter of numerals although it is to be understood that the weakened severance lines do extend through the side walls 15, 16, 19 and 20.

Figure 8:
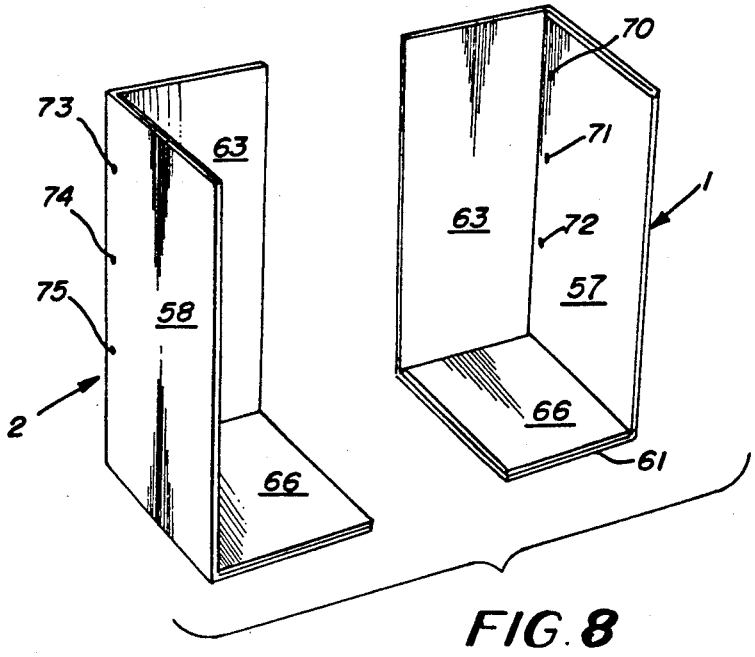
FIG. 8 perspective view of a pair of separate spaced apart upright a supports formed according to this invention.

In order properly to mount the shelf, suitable shelf ends are provided and are disjointably mounted to the ends of base panel 8 and of the double front and back walls and serve as convenient means for attaching the shelf ends to the upright supports shown in FIG. 8, the distance between such upright shelves being adjustable as desired to accommodate different shelf lengths in accordance with this invention.

Figure 3:
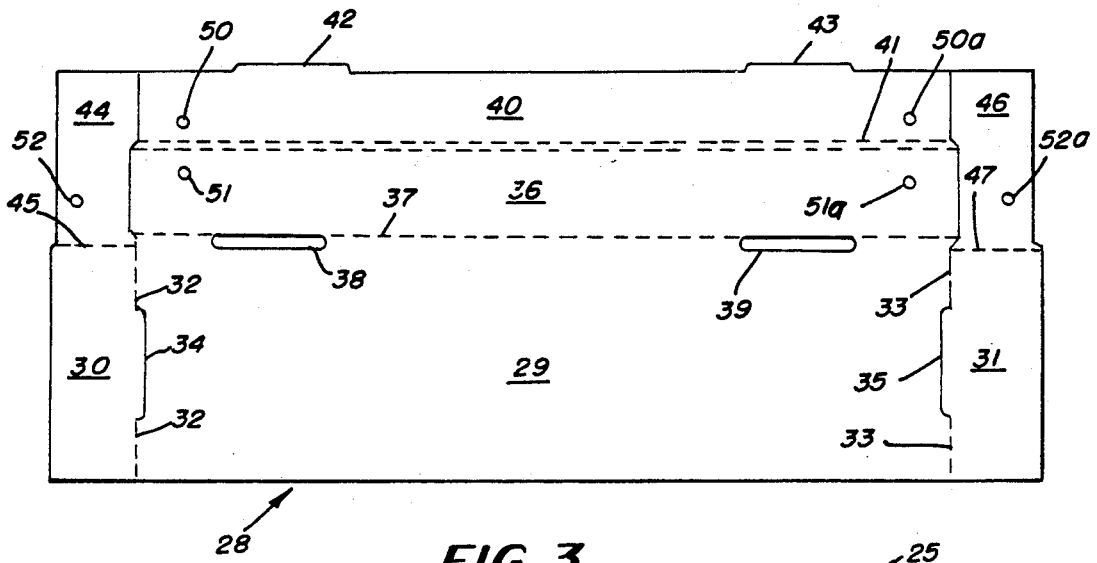

FIG. 3 is a plan view of a shelf end designated generally by the numeral 28. Shelf end 28 includes a main panel designated by the numeral 29 to the ends of which side walls 30 and 31 are foldably joined along interrupted fold lines 32 and 33 respectively. Holding tabs 34 and 35 are formed along edges of side walls 30 and 31. Outer end panel 36 is foldably joined to main panel 29 along fold line 37 and a pair of holding apertures 38 and 39 are formed along fold line 37 and are taken from main panel 29. Inner end panel 40 is foldably joined to outer end panel 36 along double fold line 41 and holding tabs 42 and 43 project from an edge of inner end panel 40. Corner flap 44 is foldably joined to side wall 30 along fold line 45 and corner flap 46 is foldably joined to side wall 31 along fold line 47.

In order to assemble the shelf end 28 into the set up condition represented in FIG. 4 by manipulating the blank of FIG. 3, the side walls 30 and 31 are folded upwardly and inwardly toward each other into perpendicular relationship relative to main panel 29. Thereafter the corner flaps 44 and 46 are folded inwardly along fold lines 45 and 47 into positions of perpendicular relationship with respect to the side walls 30 and 31. Thereafter the outer end panel along with the inner end panel are folded upwardly and forwardly as viewed in FIG. 3 along fold line 37 until these panels occupy perpendicular positions relative to main panel 29. Thereafter inner end panel 40 is folded forwardly and downwardly into flat face contacting relation with the outer end panel 36 and in such a manner as to envelope the corner flaps 44 and 46 between inner end panel 40 and outer end panel 36. The parts are maintained in set up position by insertion of the holding tab 42 into the holding aperture 38 and by simultaneously inserting the holding tab 43 into the holding aperture 39. The set up shelf end 28 then appears as indicated in FIG. 4.

During this manipulation into set up condition of the shelf ends 28 the apertures 50, 51 and 52 formed in inner end panel 40, in outer end panel 36 and in corner flap 44 are swung into coincidence with each other. Apertures 50*a*, 51*a* and 52*a* are similarly manipulated.

In order to mount the shelf end 28 to an end of the shelf, the main panel 29 is moved into overlapping relation with the end portion 8*a* of base panel 8 and simultaneously the side wall 31 is interposed between the spaced outer side wall panel 15 and the inner side wall panel 19 and the holding tab 25 and the holding tab 34 are inserted into holding aperture 26*a*. Similarly at the other extremity of shelf end 28, the side wall 30 is inserted between outer side wall panel 16 and inner side wall panel 20, these side wall panels being positioned apart somewhat, so as to receive the side wall 30 therebetween. In like fashion the holding aperture 24*a* receives the holding tabs 23 and 34. In like fashion, the shelf end at the opposite end of the shelf is mounted in an identical fashion.

Figure 9:
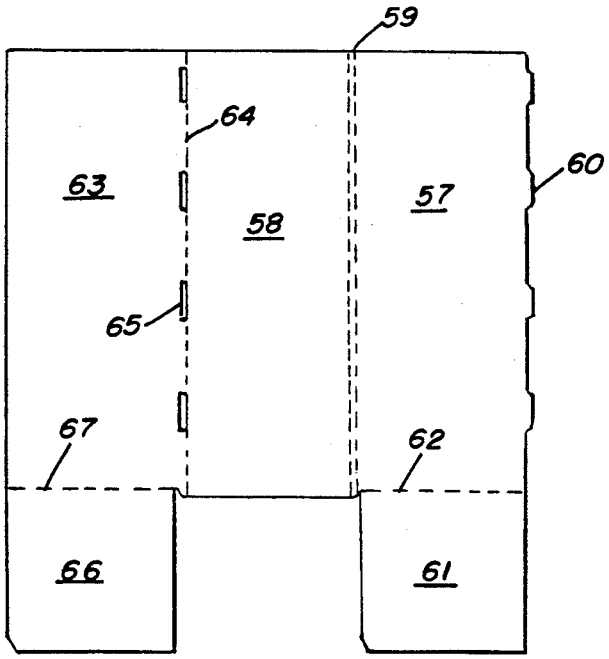
FIG. 9 is a plan view of a blank used forming the upright supports shown in FIG. 8.
Figure 10:
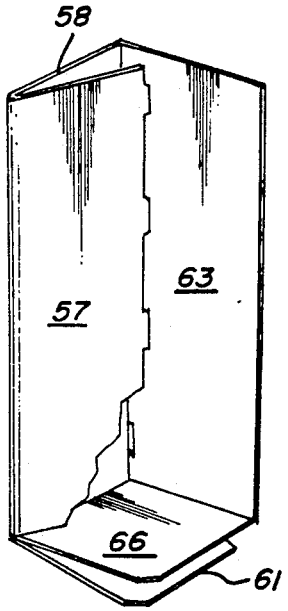
FIG. 10 is a view of one upright support shown in partially assembled conditioner and which is formed from the blank of FIG. 9.

The shelves whose lengths are adjustable as is evident particularly from FIG. 4 are supported at their ends by upright supports best shown in FIGS. 8, 9 and 10 and which are designated 1 and 2. Of course, these upright supports are movable inwardly toward each other and outwardly in a direction away from each other so as to accommodate the length chosen for the shelves and for the floor panel 3. For example, the upright support 1 includes double wall panels 57 and 58 which are foldably joined along double fold line 59. A plurality of holding tabs 60 are formed along an edge of panel 57 and a bottom panel 61 is foldably joined to panel 57 along a fold line 62. Back panel 63 is foldably joined to panel 58 along fold line 64 and includes a plurality of holding apertures 65. A bottom panel 66 is foldably joined to panel 63 along fold line 67. In order to form the vertical upright 1 as shown in FIG. 8, the vertical panel 57 is folded upwardly and toward the left as viewed in FIG. 9 along the double fold line 59 and into flat face contacting relation with the panel 58. This folding operation results in the insertion of folding tabs 60 into corresponding holding apertures 65. During this manipulation, the bottom panel 66 is arranged to lie in flat face contacting relation with the upper surface of bottom panel 61.

In order to form the upright support 2 from the blank shown in FIG. 9, the panel 57 is folded along double fold line 59 into face contacting relation with the underside of panel 58 as viewed in FIG. 9. Thereafter, the panel 63 is folded downwardly and into normal relation with panel 58 along fold line 64 to occupy the position represented in upright support 2 in FIG. 8. Of course, this folding operation causes the holding tabs 60 to enter the corresponding holding aperture 65 and the bottom panel 66 is arranged in overlying relation with relation to the bottom panel 61.

Figure 2:
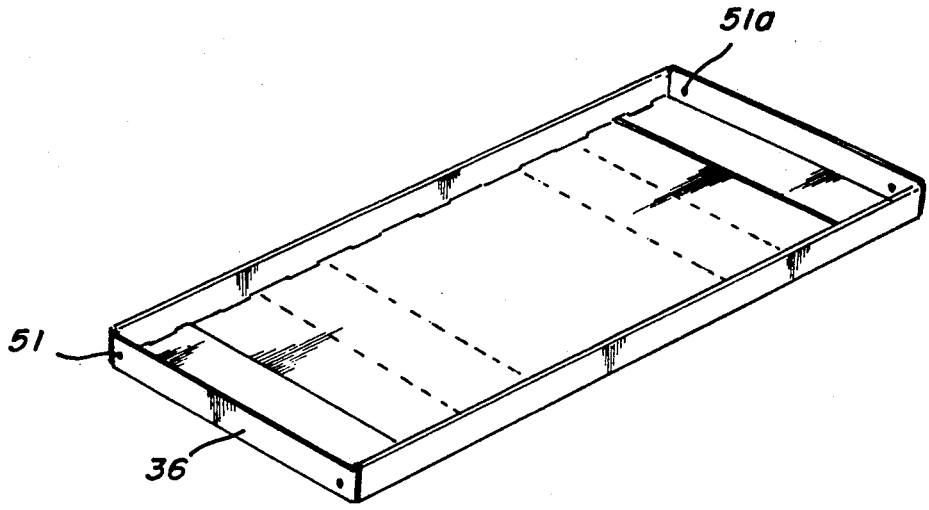
FIG. 2 is a perspective view of an assembled shelf formed according to this invention; FIG. view of a blank used in forming shelf ends which are removably mounted at the ends of the shelf shown in FIG. 2.
Figure 6:
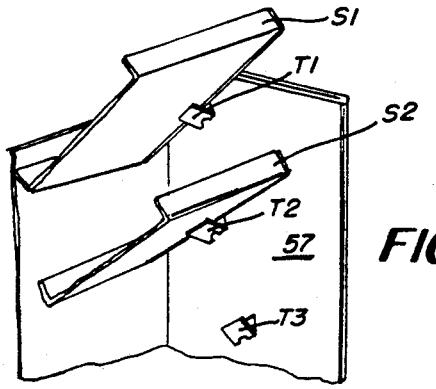
FIG. 6 is an enlarged fragmentary perspective inside view of a corner of a stand showing pivotally mounted shelves and hingedly mounted tabs for holding shelves in their upright positions represented in FIG. 5.
Figure 5:
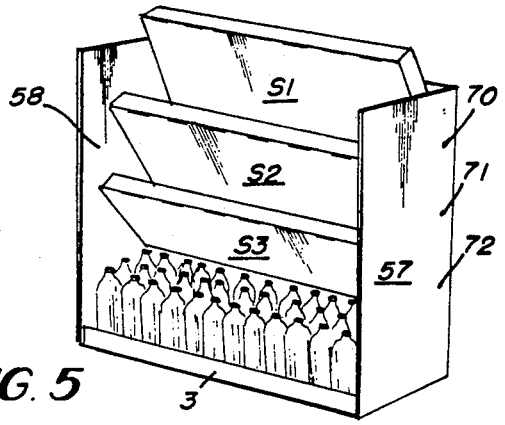
FIG. 5 is a view similar to FIG. 1 which shows shelves which are pivotally mounted and arranged to swing upwardly and away from items disposed on a shelf or a base panel disposed immediately therebelow.
Figure 11:
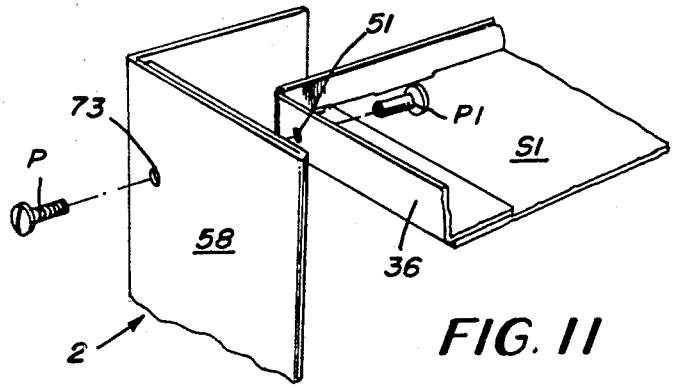
FIG. 11 is a fragmentary exploded perspective view of the mounting means by which individual shelves are pivotally mounted on the upright supports.

The shelf S1 such as is shown in FIG. 2 is pivotally mounted to the upright supports 1 and 2 by pivots P and P1 as best shown in FIG. 11 which enter apertures such as 73 formed in the double wall 58 of upright support 2 and which also enter the aperture 51 formed in the shelf end 28. In like fashion, pins P and P1 enter the aperture 51*a* at the opposite end of the shelf as shown in FIG. 2 and also enter aperture 70 of upright support 1. Each shelf such as S2 and S3 is pivoted by pins P and P1 disposed in apertures 71, 72, 73 and 74 and may swing upwardly as items are sold so as to expose items disposed therebelow to easy view and access. Shelves are held in their upper positions as shown in FIG. 6 by tabs such as T1, T2 and T3 as shown in FIG. 6.

From the above description, it is apparent that by this invention an adjustable shelf is provided whose overall dimensions and capacity may be adjusted as desired to meet varying requirements as to space and for other purposes.

We claim:

1. An adjustable display stand comprising a pair of spaced apart separate upright supports, a plurality of shelves supported at their ends by said upright supports, each of said shelves having a length and including means to reduce said shelf length and having holding apertures, said means including a plurality of transverse severance lines formed on said shelves which define severable components, whereby said shelf length is reduced by severing one or more of said components from an adjacent component, a pair of shelf ends each having a pair of holding tabs projecting downwardly therefrom and respectively secured to opposite ends of each of said shelves by insertion of said holding tabs into corresponding ones of said holding apertures respectively, at least one shelf end of each pair of shelf ends being disjointable from and reconnectable with its associated shelf, by removing and reinserting said holding tabs into said holding apertures, and mounting means for securing each of said shelf ends to an associated one of said upright supports.

2. An adjustable display stand according to claim 1 wherein said upright supports, said shelves and said shelf ends are formed of corrugated material.

3. An adjustable display according to claim 2 wherein each of said upright supports comprises a vertically disposed back panel, a vertically disposed side panel foldably joined in angular relation to a vertical edge of said vertically disposed back panel, and a bottom panel foldably joined to the bottom edge of each of said vertically disposed panels, said bottom panels being disposed in flat face contacting relation to each other.

4. An adjustable display according to claim 3 wherein each of said vertically disposed side panels is of double ply construction including an inner and an outer ply foldably joined along a vertical fold line.

5. An adjustable display according to claim 4 wherein a plurality of holding tabs are formed along a vertical edge of the inner ply of each of said side panels and arranged for disposition respectively in a plurality of holding apertures formed in each of said vertically disposed back panels along said vertical edge thereof.

6. An adjustable display according to claim 2 wherein each of said shelf ends comprises a main panel arranged for disposition above and in flat face contacting relation with one end of one of said shelves, an outer end panel foldably joined to an end edge of said main panel, an inner end panel foldably joined to an edge of said outer end panel remote from said main panel and disposed in face contacting relation with said outer end panel, a plurality of holding tabs formed along the edge of said inner end panel adjacent said main panel and disposed in a plurality of holding apertures formed in said main panel and disposed to receive said holding tabs respectively, side walls foldably joined to the side edges of said main panel and disposed in normal relation thereto, and a corner flap foldably joined to the end of each of said side walls adjacent said outer end panel and said inner end panel, each of said corner flaps being interposed between said outer and said inner end panels.

7. An adjustable display according to claim 6 wherein a holding aperture is formed in said main panel adjacent each of said side walls and disposed to receive a holding tab formed on the adjacent edge of each of said inner panels.

8. An adjustable display according to claim 7 wherein coincident apertures are formed in each of said corner flaps and in the adjacent ends of said inner and said outer end panels.

9. An adjustable display according to claim 8 wherein said mounting means comprises pivot pins disposed in said coincident apertures and in corresponding apertures formed in each of said upright supports.

10. An adjustable display according to claim 9 wherein said corresponding apertures are formed in each of said vertically disposed side panels.

11. An adjustable display according to claim 10 wherein each of said shelves is arranged to swing upwardly about said pivot pins so as to expose displayed items disposed therebelow.

12. An adjustable display according to claim 1 wherein each of said shelves comprises a base panel having at least one weakened transverse severance line formed therein, a pair of walls foldably joined respectively along the front and back edges of said base panel and disposed in perpendicular relation thereto, each wall of said pair of walls comprising an outer panel foldably joined respectively to front and back edges of said base panel and an inner panel foldably joined to the edge of the associated one of said outer panels which is remote from said base panel and wherein said outer and said inner panels are disposed in flat face contacting relation to each other.

13. An adjustable display according to claim 12 wherein a plurality of holding tabs are formed along the edges of said inner panels which are adjacent said base panel and arranged for disposition in a plurality of holding apertures formed in said base panel adjacent the fold lines between said outer panels and said base panel.

14. An adjustable display according to claim 1 wherein both shelf ends of each pair of shelf ends are disjointably mounted on opposite ends respectively of the associated shelf.

* * * * *